US005867197A

United States Patent [19]

Aoki

[11] Patent Number: 5,867,197

[45] Date of Patent: Feb. 2, 1999

[54] INK-JET PRINTING CLOTH, INK-JET PRINTING PROCESS AND PRODUCTION PROCESS OF PRINT

[75] Inventor: Makoto Aoki, Yokohama, Japan

[73] Assignee: Canon Kabushiki Kaisha, Tokyo, Japan

[21] Appl. No.: 503,029

[22] Filed: Jul. 17, 1995

[30] Foreign Application Priority Data

| | | | |
|---|---|---|---|
| Jul. 21, 1994 | [JP] | Japan | 6-169823 |
| Oct. 26, 1994 | [JP] | Japan | 6-262269 |

[51] Int. Cl.[6] ..... B41J 3/407; B41J 2/01; B05D 5/00; D03D 3/00

[52] U.S. Cl. ..... 347/106; 347/100; 347/103; 427/288; 428/224

[58] Field of Search ..... 347/106; 346/11; 427/288; 106/22 R, 22; 524/805; 428/224

[56] References Cited

U.S. PATENT DOCUMENTS

| | | | |
|---|---|---|---|
| 4,725,849 | 2/1988 | Koike et al. | 346/1.1 |
| 5,346,949 | 9/1994 | Fukazawa | 524/805 |
| 5,494,733 | 2/1996 | Koike et al. | 428/224 |

FOREIGN PATENT DOCUMENTS

| | | |
|---|---|---|
| 0212655A2 | 3/1987 | European Pat. Off. . |
| 568955A1 | 11/1993 | European Pat. Off. . |
| 0605730A1 | 7/1994 | European Pat. Off. . |
| 631005A1 | 12/1994 | European Pat. Off. . |
| 60-99081 | 6/1985 | Japan . |
| 61-55277 | 3/1986 | Japan . |
| 0459282 | 2/1992 | Japan . |

OTHER PUBLICATIONS

Database WPI, Derwent Publications Ltd., Class A35, AN 94–186718, XP–002056357 (JP 6–123086, May 6, 1994).
Database WPI, Derwent Publications, Ltd., Class A82, AN 86–039576, XP–002056358 (JP 6–260376, Dec. 23, 1985).
Derwent (Database WPIL) Week 8528, AN 85–168957 with respect to JP 60–99 081 A of Jun. 1, 1985.

*Primary Examiner*—Peter S. Wong
*Assistant Examiner*—Rajnikant B. Patel
*Attorney, Agent, or Firm*—Fitzpatrick, Cella, Harper & Scinto

[57] ABSTRACT

Disclosed herein is an ink-jet printing cloth on which textile printing is conducted using an ink-jet system, wherein the cloth contains a water repellent and a hydrophilic agent so as to have a predetermined water repellency.

32 Claims, 4 Drawing Sheets

INK-JET PRINTING CLOTH, INK-JET PRINTING PROCESS AND PRODUCTION PROCESS OF PRINT

BACKGROUND OF THE INVENTION

1. Field of the Invention

The present invention relates to an ink-jet printing cloth, an ink-jet printing process and a production process of a print.

2. Related Background Art

Besides screen printing and roller printing, ink-jet printing has heretofore been known as a process of printing on cloth formed of cotton, silk, polyester or the like. This ink-jet printing is conducted by means of an ink-jet printing apparatus obtained by improving an image-forming apparatus of an ink-jet system for forming images on recording media such as plastics and recording paper so as to be fitted for textile printing and the kind of cloth to be used.

The ink-jet system is a non-impact printing system, which ejects an ink or the like to directly apply the ink to cloth or the like and produces little noise. A textile printing apparatus equipped with an ink-jet system printing head permits high-density printing operation at high speed. The textile printing processes using a plate such as a screen or a design roller are unfit for multi-kind small-quantity production, whereas the ink-jet textile printing process is a system making no use of any plate, and permits multi-kind small-quantity production in a short period of time because data for printing can be formed with ease by a host system or the like.

The textile printing apparatus of the ink-jet system is generally equipped with a printing means (printing head) mounted on a carriage, a feeding means for feeding a cloth and control means for controlling these means. The printing head by which ink droplets are ejected through a plurality of ejection orifices is serially scanned in a direction (a main scanning direction) perpendicular to the feeding direction (a secondary scanning direction) of the cloth. On the other hand, the cloth is intermittently fed by a predetermined length at the time printing is stopped. According to this printing process, inks are ejected on the cloth according to printing signals to conduct printing. Therefore, the ink-jet printing process attracts attention as a printing method which is low in running cost and silent. When a printing head in which a plurality of ink-ejecting nozzles has been aligned in the secondary scanning direction is used, printing of a width corresponding to the number of the nozzles can be performed every time the printing head is scanned once on the cloth.

In the case of color textile printing, a color image is formed by overlapping ink droplets of plural colors ejected from respective printing heads. In general, color printing requires three or four printing heads and ink tanks corresponding to 3 primary colors of yellow (Y), magenta (M) and cyan (C) or 4 colors including black (B) in addition to these primary colors.

Since such devices are used, the techniques required of ink-jet printing are greatly different from those of screen and roller printing. This is caused by such differences in system as: the optimum value of viscosity of inks used in the ink-jet printing is greatly different from that of textile printing inks used in screen printing or the like and is low, ink-jet printing requires attention to reliability such as clogging of the head, the so-called additive color process, in which a few inks of different colors are shot on the same position so as to overlap each other, is conducted, and dots of inks are very small.

Various investigations have thus been attempted as to methods of such ink-jet printing. For example, Japanese Patent Publication No. 63-31594 discloses a method in which textile printing is conducted on a cloth containing a water-soluble polymer, a water-soluble salt and water-insoluble inorganic fine particles, and Japanese Patent Publication No. 63-31593 discloses a textile printing method in which inks each having a viscosity of 200 cP or lower and a surface tension of 30 to 70 dyn/cm are used, and a cloth having a water repellency of 50 points or more as measured in accordance with JIS L 1079 is employed.

Since the prior art printing methods described above are based on thinking that the penetration of inks into the interior of fiber is prevented to prevent the diffusion of dyes, thereby improving coloring, the improvement in coloring is recognized to some extent. However, they involve problems such as (1) it takes a long time to dry the inks, (2) no strike-through occurs because the inks do not spread, and (3) an area factor becomes small because the inks do not spread, and so coloring ability is limited.

On the other hand, for example, Japanese Patent Application Laid-Open No. 4-59282 discloses an ink-jet printing cloth obtained by incorporating 0.1 to 3% by weight of a surfactant into a cloth formed of a hydrophilic fiber material. According to the cloth subjected to such a treatment, inks are absorbed in the interior of the fiber by diffusion, and so the tendency to strike-through is enhanced. However, such a cloth is unfavorable with respect to improvement in coloring ability because dyes penetrate into the interior of the fiber.

As described above, the prior art techniques have been able to satisfy individual performance characteristics required of the ink-jet printing process for obtaining excellent prints to some extent, but have been unable to satisfy all the performance characteristics at the same time.

SUMMARY OF THE INVENTION

It is therefore an object of the present invention to provide an ink-jet printing cloth and an ink-jet printing process, which can provide bright prints excellent in drying property, free of bleeding and high in color depth, image quality and grade, and a production process of prints having excellent in properties.

The above object can be achieved by the present invention described below.

According to the present invention, there is thus provided an ink-jet printing cloth on which textile printing is conducted using an ink-jet system, wherein the cloth contains a water repellent and a hydrophilic agent so as to have a predetermined water repellency.

According to the present invention, there is also provided a process for producing an ink-jet printing cloth on which textile printing is conducted using an ink-jet system, which comprises the steps of:

applying a water repellent to a cloth;

drying the cloth; and further applying a hydrophilic agent to the dry cloth.

According to the present invention, there is further provided an ink-jet printing process comprising ejecting inks by an ink-jet system to print a cloth, wherein a cloth containing a water repellent and a hydrophilic agent and having a predetermined water repellency is used as said cloth.

According to the present invention, there is still further provided a process for producing a print by applying inks to a cloth using an ink-jet system to print the cloth, which comprises the steps of:

applying inks to a cloth containing a water repellent and a hydrophilic agent and having a predetermined water repellency;

fixing dyes in the inks to the cloth; and washing the thus-treated cloth.

DESCRIPTION OF THE PREFERRED EMBODIMENTS

Figures 1A, 1B:
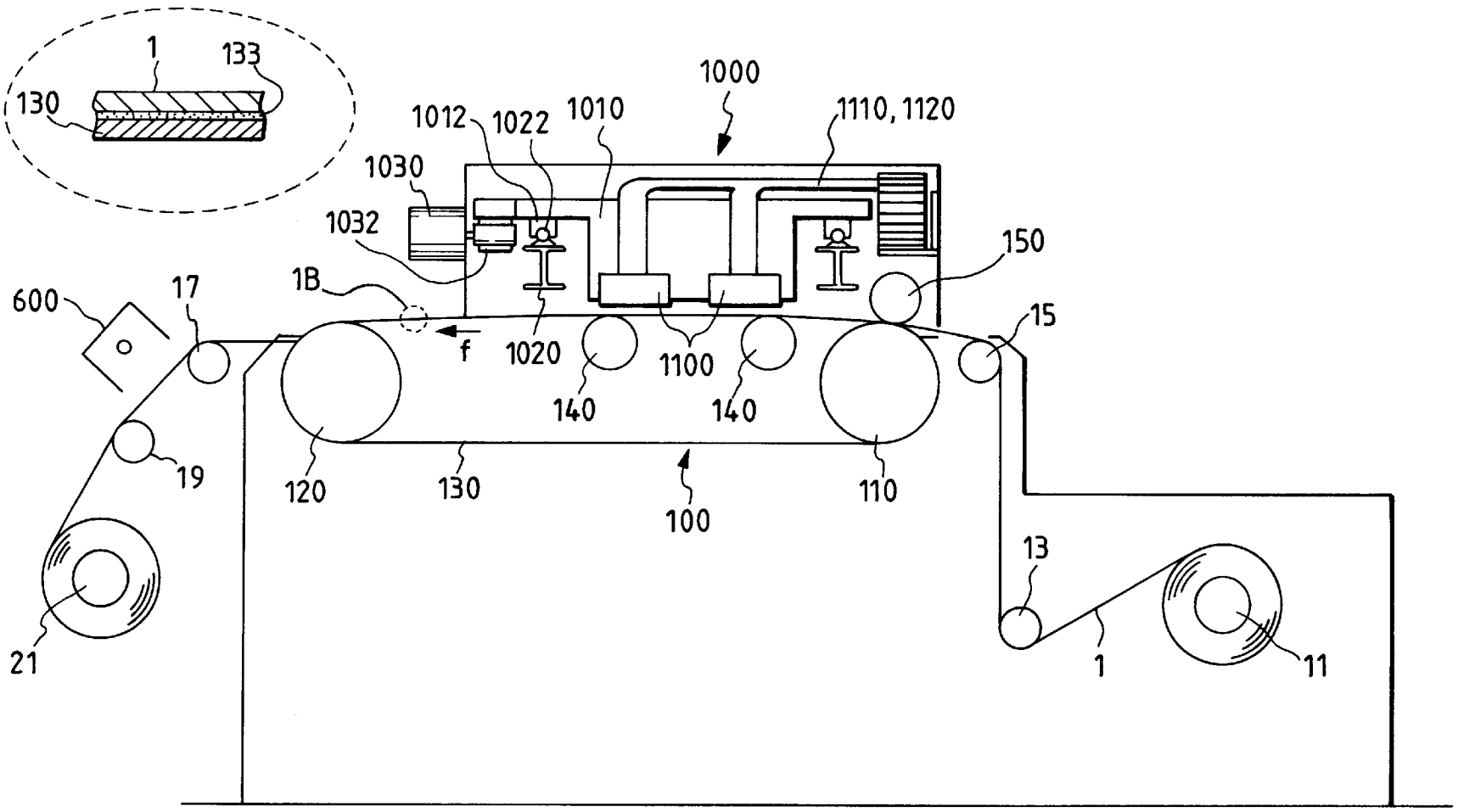
FIG. 1A is a typical sectional side elevation schematically illustrating the constitution of an ink-jet printing apparatus to which the present invention is applied.
FIG. 1B is an enlarged view of a portion of a conveyor belt in FIG. 1A.

According to the ink-jet printing cloth and printing process based on the present invention, prints excellent in drying property, coloring ability and resistance to bleeding can be provided.

According to the ink-jet printing cloth according to the present invention, inks do not penetrate very far into the interior of fiber owing to the water repellent contained therein, and so dyes do not diffuse, resulting in improvement in coloring. The hydrophilic agent simultaneously contained in the cloth moderately prevents the inks from being repelled by the water repellent. More specifically, the inks used have affinity for the hydrophilic agent, and are hence absorbed in the cloth to some extent and are also laterally spread.

Therefore, since the cloth according to the present invention also becomes excellent in drying property and great in area factor, it is also excellent in coloring ability. The term "area factor" means a proportion of dots occupied in a unit area. When the permeability (water repellency) of the cloth is preset to a value less than 50 points by uniformly containing the water repellent and the hydrophilic agent in a certain proportion in the cloth, scattering of hydrophilicity of fiber itself due to density, directional property, irregularities, impurities and the like can be lessened, and so uneven spread (bleeding) of inks can be prevented.

The preferred embodiments of the present invention will now be described to explain the present invention in more detail.

No particular limitation is imposed on the fiber material for the ink-jet printing cloth according to the present invention. Examples thereof include various fiber materials such as cotton, silk, wool, nylon, polyester, rayon and acrylic fibers. The cloth used may be a blended fabric or union cloth thereof.

The water repellency in the present invention has been measured by using, as a measuring means, the water repellency test (spray method) described in JIS L 1092.

No particular limitation is imposed on the water repellent useful in the practice of the present invention so far as it has the ability to repel water which is a main component of inks. However, examples thereof include paraffins, fluorine-containing compounds, pyridinium salts, N-methylolalkylamides, alkylethyleneureas, oxazoline derivatives, silicone compounds, triazine compounds, zirconium compounds and mixtures thereof. Of these, paraffinic and fluorine-containing type water repellents are particularly preferred from the viewpoints of easy adjustment of water repellency, prevention of bleeding and concentration.

The amount of the water repellent to be applied is 0.05 to 40% by weight based on the cloth. If the amount is less than 0.05% by weight, the effect of preventing excessive penetration of ink becomes insufficient. On the other hand, if the water repellent is contained in an amount exceeding 40% by weight, a great change in performance can no longer be brought about.

Any water-soluble polymer having a water-repellent function may also be used as the water repellent. Examples of such water-soluble polymers include starch, cellulosic substances such as carboxymethylcellulose, methylcellulose and hydroxyethylcellulose, sodium alginate, gum arabic, guar gum, gelatin, tannin and derivatives thereof, polyvinyl alcohol and derivatives thereof, polyethylene oxide and derivatives thereof, water-soluble acrylic polymers, and water-soluble maleic anhydride polymers.

The amount of the water-soluble polymer is 0.1 to 20% by weight based on the cloth. Any amount of the water-soluble polymer exceeding 20% by weight results in a cloth markedly deteriorated in desizing ability. It is also not preferred from the viewpoint of economy to use the water-soluble polymer in such a great amount. On the other hand, if the amount is less than 0.1% by weight, the effect of such an agent is not sufficiently exhibited.

The hydrophilic agent useful in the practice of the present invention is a substance capable of improving the ink-absorbing ability of a cloth when added in a predetermined amount or more to the cloth as compared with the cloth before its addition. An increase in the absorbing ability can be determined by whether the water repellency is reduced or not, and the degree of the reduction. As specific examples of a method of applying the hydrophilic agent, there are considered various methods such as a method of containing a surfactant and a method of containing a water-soluble substance having a hydrophilic group. Any of these methods may be used.

As the surfactant used for enhancing the absorbing ability, anionic, nonionic and amphoteric surfactants are preferred. As examples of the anionic surfactant, may be mentioned surfactants of the sulfonic acid, carboxylic acid, sulfuric acid ester and phosphoric acid ester types. As the nonionic surfactant, there may be used ether types such as polyoxyethylene alkyl ethers, polyoxyethylene alkyl allyl ethers and acetylene glycol, the ester types such as polyoxyethylene alkyl esters and sorbitan fatty acid esters, aminoether types such as polyoxyethylene alkylamines, ether ester types such as polyoxyethylene sorbitan fatty acid esters, and the like. As the amphoteric surfactant, there may be used betaine types and the like.

The surfactant is preferably applied in an amount of 0.01 to 50% by weight based on the cloth. If the amount exceeds 50% by weight, a change in absorbing ability can no longer be brought about, and such a great amount is hence not preferred from the viewpoint of economy. On the other hand, if the amount is less than 0.01% by weight, the effect of such an agent is not sufficiently exhibited.

As the water-soluble substance having a hydrophilic group used for improving the absorbing ability, those like water-soluble solvents generally incorporated into ink-jet inks are preferred. Examples of usable solvents include lower alkylene glycols such as ethylene glycol, diethylene glycol, triethylene glycol and propylene glycol; lower alkyl ethers of alkylene glycols, such as ethylene glycol methyl (ethyl, propyl or butyl) ether, diethylene glycol methyl (ethyl, propyl or butyl) ether, triethylene glycol methyl (ethyl, propyl or butyl) ether, propylene glycol methyl (ethyl, propyl or butyl) ether, dipropylene glycol methyl (ethyl, propyl or butyl) ether and tripropylene glycol methyl (ethyl, propyl or butyl) ether; polyalkylene glycols such as polyethylene glycol and polypropylene glycol and products obtained by modifying one or two hydroxyl groups thereof, typified by mono- or dialkyl ethers thereof; glycerol; and thiodiglycol. Most of them are liquid, but those having a high molecular weight may be solid. However, their effect is not different from that of the liquid.

The water-soluble substance having a hydrophilic group is preferably applied in an amount of 0.01 to 50% by weight based on the cloth. If the amount exceeds 50% by weight, a change in ease of wetting can no longer be brought about, and such a great amount is not preferred from the viewpoint of economy. On the other hand, if the amount is less than 0.01% by weight, the effect of such an agent is not sufficiently exhibited.

The preferable ranges of the water repellent and hydrophilic agent to be added to the cloth are as described above. However, a ratio between the amounts of these agents to be added is important. With respect to this ratio, the amounts of the water repellent and hydrophilic agent are preferably determined in such a manner that the water repellency of the resulting cloth is less than 50 points.

The cloth according to the present invention contains the above-described substances for the purpose of adjusting its water repellency, but may also contain compounds other than these substances. Examples of the compounds usable include water-soluble inorganic salts, urea, catalysts, alkalis, acids, antireductants, antioxidants, level dyeing agents, deep dyeing agents, carriers, reducing agents, oxidizing agents and metal ions.

As compounds effective in prevention of bleeding and improvement of coloring ability, may be mentioned water-soluble inorganic salts. Examples of water-soluble inorganic salts preferably used include alkali metal salts such as NaCl, $Na_2SO_4$, KCl and $CH_3COONa$, and alkaline earth metal salts such as $CaCl_2$ and $MgCl_2$.

Urea is also very effective in preventing bleeding and improving coloring ability. In particular, its combined use with the water-soluble inorganic salt has a synergistic effect and is hence preferred.

As a method of containing the above-described substances in the cloth, any method such as padding, spraying, dipping, printing or ink-jet may be used.

A cloth may be impregnated with a treating liquid containing the water repellent and hydrophilic agent. However, when a cloth is impregnated with a treating liquid containing the water repellent so as to make the cloth resistant to penetration by inks, and then dried, followed by application of the hydrophilic agent for improving the wetting property, the treating liquid for improving the wetting property does not penetrate the interior of the fiber because the fiber is impregnated with the water repellent, and so the treating liquid adheres only to the peripheral surface of the fiber. Therefore, the wetting property of the peripheral surface of the fiber is improved. As a method of determining the wetting property where it is different for the interior of fiber transit is for the peripheral surface of the fiber, as described above, such a difference can be confirmed by conducting ink-jet printing on a cloth, observing a fiber section of the resulting print to distinguish a difference in the concentration of a fixed dye between the peripheral surface and the interior in the fiber section. More specifically, if the concentration of the fixed dye on the peripheral surface side of the fiber in the fiber structure is higher than that on the interior side of the fiber, it can be said that the wetting property of the peripheral surface of the fiber is higher than that of the interior of the fiber. On the other hand, if there is little difference in the concentration of the fixed dye between the peripheral surface and the interior of the fiber, it can be said that there is no difference in the wetting property as well.

After conducting the treatment as described above, the thus-treated cloth is finally dried and optionally cut into sizes feedable into an ink-jet apparatus, thereby providing these cut pieces as ink-jet printing cloths.

No particular limitation is imposed on textile printing inks used for the ink-jet printing cloths according to the present invention. However, when the cloth is formed of a material such as cotton or silk, ink-jet textile printing inks composed of a reactive dye and an aqueous medium are preferably used. When the cloth is formed of a material such as nylon, wool, silk or rayon, ink-jet textile printing inks composed of an acid or direct dye and an aqueous medium are preferably used. Besides, when the cloth is formed of a polyester material, ink-jet textile printing inks composed of a disperse dye and an aqueous medium are preferably used.

As specific preferable examples of these dyes, may be mentioned the following dyes. The reactive dyes include C.I. Reactive Yellow 2, 15, 37, 42, 76, 95, 168 and 175; C.I. Reactive Red 21, 22, 24, 33, 45, 111, 112, 114, 180, 218, 226, 228 and 235; C.I. Reactive Blue 15, 19, 21, 38, 49, 72, 77, 176, 203, 220, 230 and 235; C.I. Reactive Orange 5, 12, 13, 35 and 95; C.I. Reactive Brown 7, 11, 33, 37 and 46; C.I. Reactive Green 8 and 19; C.I. Reactive Violet 2, 6 and 22; C.I. Reactive Black 5, 8, 31 and 39; and the like.

The acid and direct dyes include C.I. Acid Yellow 1, 7, 11, 17, 23, 25, 36, 38, 49, 72, 110 and 127; C.I. Acid Red 1, 27, 35, 37, 57, 114, 138, 254, 257 and 274; C.I. Acid Blue 7, 9, 62, 83, 90, 112 and 185; C.I. Acid Black 26, 107, 109 and 155; C.I. Acid Orange 56, 67 and 149; C.I. Direct Yellow 12, 44, 50, 86, 106 and 142; C.I. Direct Red 79 and 80; C.I. Direct Blue 86, 106, 189 and 199; C.I. Direct Black 17, 19, 22, 51, 154, 168 and 173; C.I. Direct Orange 26 and 39; and the like.

The disperse dyes include C.I. Disperse Yellow 3, 5, 7, 33, 42, 60, 64, 79, 104, 160, 163 and 237; C.I. Disperse Red 1, 60, 135, 145, 146 and 191; C.I. Disperse Blue 56, 60, 73, 143, 158, 198, 354, 365 and 366; C.I. Disperse Black 1 and 10; C.I. Disperse Orange 30 and 73; Teraprint Red 3GN Liquid and Teraprint Black 2R; and the like.

The amount (in terms of solids) of these dyes to be used is preferably within a range of from 1 to 30% by weight based on the total weight of the ink.

As a water-soluble solvent used together with the dyes, there may be used any water-soluble solvent generally used in ink-jet inks. Preferable examples thereof include lower alkylene glycols such as ethylene glycol, diethylene glycol, triethylene glycol and propylene glycol; lower alkyl ethers of alkylene glycols, such as ethylene glycol methyl (ethyl, propyl or butyl) ether, diethylene glycol methyl (ethyl, propyl or butyl) ether, triethylene glycol methyl (ethyl, propyl or butyl) ether, propylene glycol methyl (ethyl, propyl or butyl) ether, dipropylene glycol methyl (ethyl, propyl or butyl) ether and tripropylene glycol methyl (ethyl, propyl or butyl) ether; polyalkylene glycols such as polyethylene glycol and polypropylene glycol and products obtained by modifying one or two hydroxyl groups thereof, typified by mono- or dialkyl ethers thereof; glycerol; thiodiglycol; sulfolane; N-methyl-2-pyrrolidone; 2-pyrrolidone; and 1,3-dimethyl-2-imidazolidinone. The preferable content of these water-soluble solvents is generally within a range of from 0 to 50% by weight based on the total weight of the ink.

In the case of a water-based ink, the content of water as a principal component is preferably within a range of from 30 to 95% by weight based on the total weight of the ink.

Besides the above components, anti-clogging agents such as urea and derivatives thereof, dispersants, surfactants, viscosity modifiers such as polyvinyl alcohol, cellulosic compounds and sodium alginate, pH adjustors, optical whitening agents, mildewproofing agents, and the like may be added as other ingredients for inks as needed.

As an ink-jet recording method and apparatus used, there may be used any method and apparatus conventionally known. Examples thereof include a method and an apparatus in which thermal energy corresponding to recording signals is applied to an ink within a recording head, and ink droplets are generated by this thermal energy.

The inks applied onto the ink-jet printing cloth of this invention in accordance with the process of the present invention in the above-described manner only adhere to the cloth in this state. Accordingly, it is preferable to subsequently subject the cloth to a process for fixing the dyes in the inks to fiber and a process for removing unfixed dyes. Such a fixing process may be conducted in accordance with any conventionally-known method. Examples thereof include a steaming process, an HT steaming process and a thermofix process. The removal of the unreacted dyes may be performed by any washing process conventionally known.

After conducting the ink-jet printing and the post-treatment of the cloth in the above-described manner, the cloth is dried to provide a print according to the present invention.

An exemplary constitution of an ink-jet printing apparatus used in the present invention will hereinafter be roughly described. It goes without saying that the apparatus to which the present invention can be applied is not limited to the construction as described below. It is therefore possible to make any change in construction and add any structural element, which are easily conceived by those skilled in the art.

FIG. 1A is a typical sectional side elevation schematically illustrating the construction of a printing apparatus. Reference numeral 1 designates a cloth as a printing medium. The cloth 1 is unwound according to the rotation of a rewind roller 11, fed in a substantially horizontal direction by a conveyance section 100, which is provided at a position opposite to a printer section 1000, through intermediate rollers 13 and 15, and then wound up on a take-up roller 21 through a feed roller 17 and an intermediate roller 19.

The conveyance section 100 roughly includes conveyance rollers 110 and 120 respectively provided on the upstream and downstream sides of the printer section 1000 viewing from the feeding direction of the cloth 1, a conveyor belt 130 in the form of an endless belt, which is extended between and around these rollers, and a pair of platen rollers 140 provided so as to extend the conveyor belt 130 under an appropriate tension in a predetermined range to enhance its evenness, thereby evenly regulating the surface of the cloth 1 to be printed upon by the printer section 1000. In the illustrated apparatus, the conveyor belt 130 is made of a metal as disclosed in Japanese Patent Application Laid-Open No. 5-212851. As illustrated in FIG. 1B with partial enlargement, an adhesive layer (sheet) 133 is provided on its surface. The cloth 1 is adhered to the conveyor belt 130 through the adhesive layer 133 by an attaching roller 150, thereby ensuring the evenness of the cloth 1 upon the printing.

To the cloth 1, fed in a state such that the evenness has been ensured as described above, is applied a printing agent in the region between the platen rollers 140 by the printer section 1000. The thus-printed cloth 1 is separated from the conveyor belt 130, or the adhesive layer 133 at the position of the conveyance roller 120 and wound up on the take-up roller 21. In the course of the winding, the cloth is subjected to a drying treatment by a drying heater 600. In particular, this drying heater 600 is effective when a liquid agent is used as the printing agent. The form of the drying heater 600 may be suitably selected from a heater by which hot air is blown on the cloth 1, a heater by which infrared rays are applied to the cloth 1, and the like.

Figure 2:
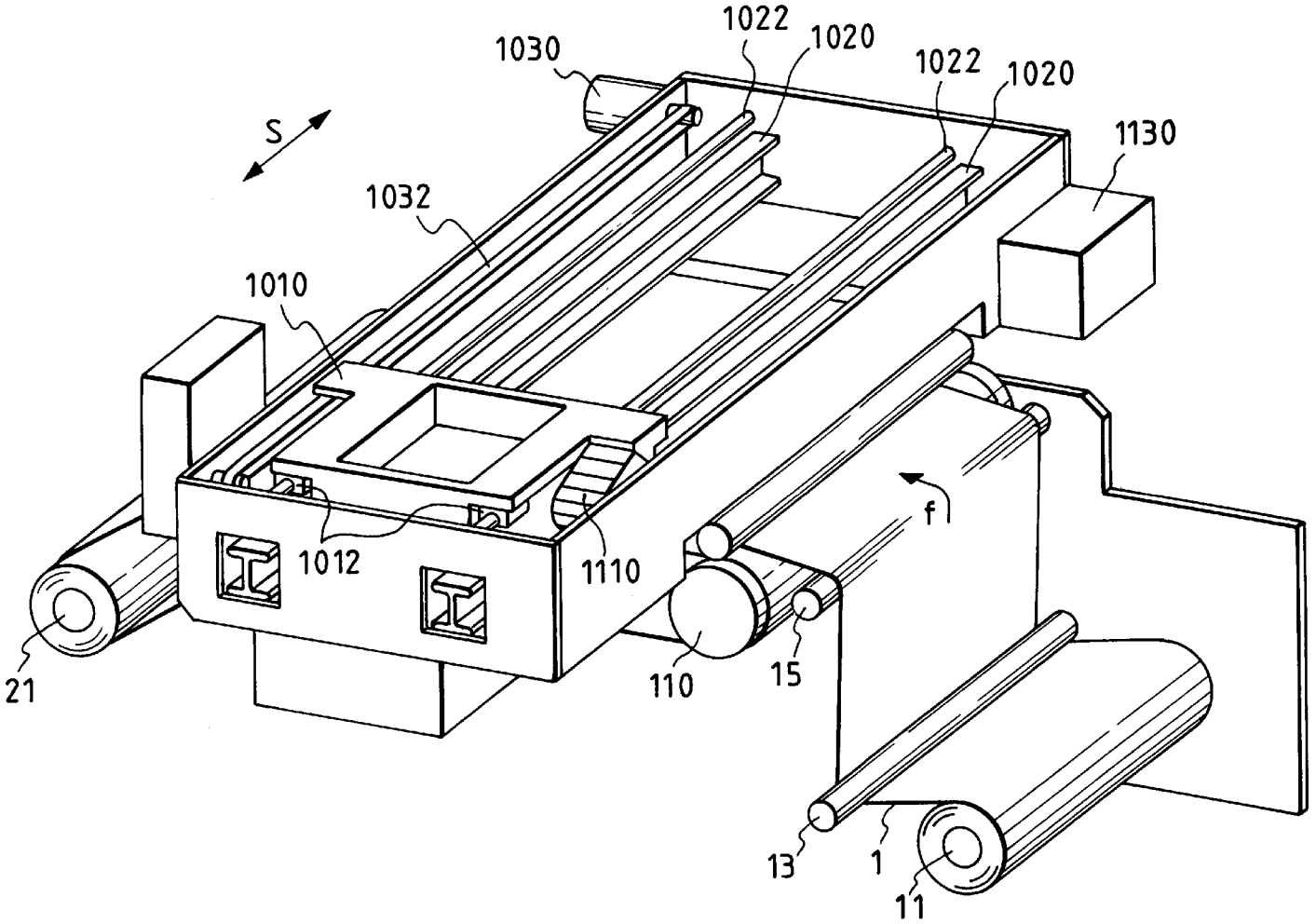
FIG. 2 is a perspective view typically illustrating a printer section and a feed section in the apparatus shown in FIG. 1A.

FIG. 2 is a perspective view typically illustrating the printer section 1000 and the feed system of the cloth 1. The constitution of the printer section 1000 will be described with reference to this drawing and FIG. 1A.

In FIGS. 1A and 2, the printer section 1000 includes a carriage 1010 which scans in a direction different from the conveying direction (a secondary scanning direction) f of the cloth 1, for example, the width direction S of the cloth 1 perpendicular to the conveying direction f. Reference numeral 1020 designates a support rail extending in the S direction (a main scanning direction) and supporting a slide rail 1022 which supports and guides a slider 1012 fixed to the carriage 1010. Reference numeral 1030 indicates a motor as a drive source for conducting the main scanning of the carriage 1010. The driving power thereof is transmitted to the carriage 1010 through a belt 1032 to which the carriage 1010 has been fixed, or another suitable drive mechanism.

On the carriage 1010, are mounted sets of printing heads 1100 each having many printing agent-applying elements arranged in a predetermined direction (in this case, the conveying direction f), said sets each being composed of a plurality of the printing heads 1100 arranged in a direction (in this case, the main scanning direction S) different from said predetermined direction. In this embodiment, two sets of the printing heads 1100 are held in the conveying direction. In each set, the printing heads 1100 are provided in a number corresponding to the number of printing agents of different colors, thereby permitting color printing. Colors of the printing agents and the number of the printing heads in each set may be suitably selected according to an image intended to be formed on the cloth 1, and the like. For example, yellow (Y), magenta (M) and cyan (C), or the three primary colors for printing, or black (Bk) in addition to these colors may make one set. Alternatively, special colors (metallic colors such as gold and silver, and bright red, blue, etc.), which are impossible or difficult to be expressed by the three primary colors, may be used in place of or in addition to the above color set. Further, a plurality of printing agents may be used according to their color depth even if they have the same colors as each other.

In this embodiment, as illustrated in FIG. 1A, two sets of the printing heads 1100, which each are composed of plural printing heads arranged in the main scanning direction S, are provided one by one in the conveying direction f. The colors, arranging number, arranging order and the like of the printing agents used in the printing heads in the respective sets may be the same or different from each other according to the image intended to be printed, and the like. Further, printing may be made again by the printing heads of the second set on a region printed by main scanning of the printing heads of the first set (either complementary thinning-out printing or overlap printing may be conducted by the respective sets of the printing heads). Furthermore, a printing region may be allotted to each set to perform high-speed printing. Besides, the number of sets of the printing heads is not limited to two and may also be defined as one or more than two.

In these drawings, ink-jet heads, for example, bubble jet heads proposed by Canon Inc., each having a heating element which generates thermal energy causing film boiling of ink as energy used for ejecting the ink, are used as the printing heads 1100. Each of the printing heads is used in a state that ink ejection orifices as the printing agent-applying elements have been disposed downward toward the cloth 1 substantially horizontally conveyed by the conveyance section 100, thereby ironing out the difference in water head between the individual ejection orifices and hence making ejection conditions uniform to permit both formation of good images and even purging operation for all the ejection orifices.

A flexible cable 1110 is connected to each of the printing heads 1100 in such a manner that it follows the movement of the carriage 1010, so that various signals such as drive signals and state signals for the head are transferred between the head and control means not illustrated. Inks are fed from an ink-feeding system 1130, in which respective inks of different colors are contained, to the printing heads 1100 through flexible tubes 1120.

Figure 3:
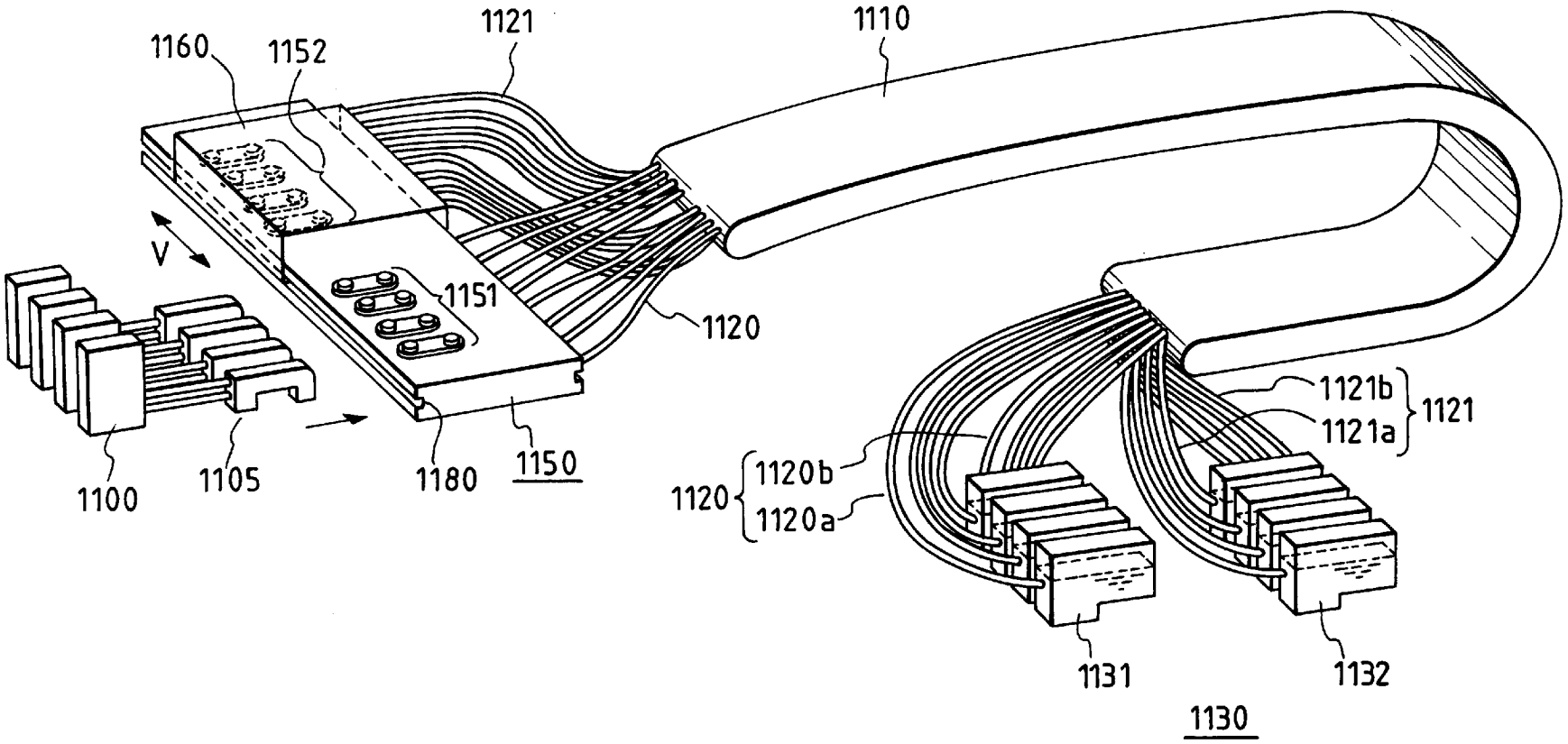
FIG. 3 is a typical perspective view of an ink-feeding system in the apparatus shown in FIG. 1A.

FIG. 3 is a perspective view typically illustrating the ink-feeding system in this embodiment. The ink-feeding system 1130 is composed of two lines. More specifically, in the first line, first ink-feeding tubes 1120 respectively connected to the first set of ink-storage tanks 1131 are connected to a head joint 1150 through the flexible tube 1110. In the second line, similarly, second ink-feeding tubes 1121 respectively connected to the second set of ink-storage tanks 1132 are connected to the head joint 1150 through the flexible tube 1110.

Each ink-feeding tube 1120 or 1121 forms a circulation path composed of an outward ink-feeding tube 1120*a* or 1121*a* and an inward ink-feeding tube 1120*b* or 1121*b*.

The ink-storage tanks 1131 and 1132 each have a pressure pump not illustrated. The ink in the tank 1131 or 1132 is pressurized by this pressure pump so as to pass through the outward ink-feeding tube 1120*a* or 1121*a* as illustrated in FIG. 3, circulate through the printing head 1100 and then pass through the inward ink-feeding tube 1120*b* or 1121*b*, thereby returning to the ink-storage tank 1131 or 1132.

By this pressure pump, it is possible to recharge the inks into the ink-feeding tubes 1120 and 1121 and also to conduct a purging operation of the head by circulating the ink through the head and discharging a fraction of this ink out of nozzles in the head. The ink-storage tanks 1131 and 1132 may be provided respectively by a number corresponding to the number of the printing agents of different colors, thereby permitting color printing.

The number of the ink-storage tanks in each set may be suitably selected according to an image intended to be formed on the cloth 1, and the like. For example, three tanks for yellow (Y), magenta (M) and cyan (C) colors, or the three primary colors for printing, or four tanks with a tank for a black (Bk) color added to these tanks may be provided. Alternatively, tanks for special colors (metallic colors such as gold and silver, and bright red, blue, etc.), which are impossible or difficult to be expressed by the three primary colors, may be used in place of or in addition to the above tanks. Further, a plurality of tanks may be used according to the color depth even if printing agents used have the same colors as each other.

The head joint 1150 is composed of a head joint 1151 for the first set indicated by a full line, a head joint 1152 for the second set indicated by a broken line and a joint cover 1160.

The constitution of the head used in the above-described apparatus will hereinafter be described schematically with reference to FIG. 4.

Figure 4:
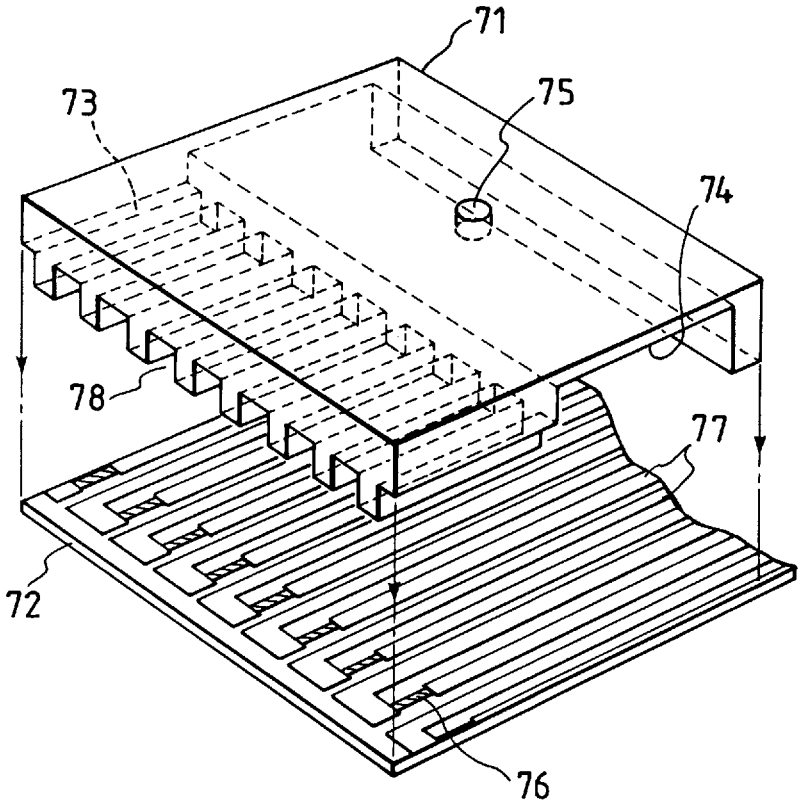
FIG. 4 is a perspective view schematically illustrating the constitution of a printing head to be mounted on the apparatus shown in FIG. 1A.

FIG. 4 is a sectional perspective view schematically illustrating the of an ink-jet head to be mounted on the ink-jet printing apparatus used in the present invention.

In this drawing, the printing head is constructed by overlapping a top plate 71 and a base plate 72. The top plate 71 has a plurality of grooves 73, which are to define nozzles passing an ink therethrough, a groove 74, which is to define a common liquid chamber communicating with these grooves, and a feed opening 75 for feeding the ink to the common liquid chamber. On the other hand, the base plate 72 includes electrothermal converters 76 corresponding to the individual nozzles and electrodes 77 for supplying electric power to the electrothermal converters 76, respectively, said electrothermal converters and electrodes being formed integrally by a film-forming technique. Ejection openings (orifices) 78 through which the ink is ejected are defined by overlapping the top plate 71 and the base plate 72 as described above.

Here, the process of forming ink droplets by the bubble jet system, which is carried out by the above-described printing head, will be described simply.

When a heating resistor (heater) reaches a predetermined temperature, such a filmy bubble as covers a heater surface is first formed. The internal pressure of this bubble is very high, and so an ink within a nozzle is forced out. The ink is moved toward the outside of the nozzle and the interior of the common liquid chamber by inertia force by this forcing out. When the movement of the ink is facilitated, the moving speed of the ink within the nozzle becomes slow because the internal pressure of the bubble turns negative pressure, and flow path resistance also arises in addition. Since the ink portion ejected out of the ejection opening (orifice) is faster in moving speed than the ink within the nozzle, it is constricted by the balance among inertia force, flow path resistance, shrinkage of the bubble and surface tension of the ink, whereby the ink portion is separated into a droplet. At the same time as the shrinkage of the bubble, the ink is fed to the nozzle from the common liquid chamber by capillary force to wait for the next pulse.

As described above, the printing head (hereinafter may be referred to as an ink-jet head), in which the electrothermal converter is used as an energy-generating means (hereinafter may be referred to as an energy-generating element), can generate a bubble in the ink within the flow path in one-to-one correspondence in accordance with a driving electrical pulse signal and also immediately and appropriately cause the growth/shrinkage of the bubble, and so the ejection of ink droplets can be achieved with excellent responsiveness in particular. The printing head is advantageous in that it can also be made compact with ease, merits of IC techniques and macro processing techniques in the recent semiconductor field, which are remarkable for advances in technique and enhancement in reliability, can be fully applied thereto, high-density mounting can be achieved with ease, and production costs are also low.

The present invention will hereinafter be described more specifically by the following examples and comparative examples. Incidentally, all designations of "part" or "parts" and "%" as will be used in the following examples mean part or parts by weight and % by weight unless expressly noted.

EXAMPLES 1 to 12

(A) Production of ink-jet printing cloth

Using a 100% cotton satin fabric (mercerized product), a 100% nylon taffeta fabric and a 100% polyester tropical fabric, pretreatments using their corresponding pretreatment agents shown in Table 1 were conducted by the padding process. The thus-pretreated fabrics were then squeezed to a pickup of 70% by a mangle and dried at a drying temperature of 120° C. for 2 minutes.

(B) Preparation of ink-jet printing ink

Reactive dye inks, acid dye inks and disperse dye inks were prepared in the following manner. The total amounts of the inks are all 100 parts.

(1) Reactive dye inks:

Reactive dye 10 parts

Thiodiglycol 40 parts

Water 50 parts.

Dyes used were C.I. Reactive Yellow 95, C.I. Reactive Red 226, C.I. Reactive Blue 15 and C.I. Reactive Black 39.

(2) Acid dye inks

Acid dye 10 parts

Diethylene glycol 40 parts

Water 50 parts.

Dyes used were C.I. Acid Yellow 110, C.I. Acid Red 266, C.I. Acid Blue 90 and C.I. Acid Black 26.

(3) Disperse dye inks:

Disperse dye 10 parts

Thiodiglycol 40 parts

Water 50 parts.

Dyes used were C.I. Disperse Yellow 42, Teraprint Red 3GN Liquid (trade name, product of Ciba-Geigy AG), C.I. Disperse Blue 56 and Teraprint Black 2R (trade name, product of Ciba-Geigy AG).

(C) Ink-jet printing

Using a Bubble Jet Printer BJC-820J (trade name, manufactured by Canon Inc.) as an ink-jet printing apparatus, sets of the above-prepared printing inks were separately charged in this printer. The fabrics were separately mounted on base paper webs to permit the conveying of the fabrics, thereby printing the fabrics. Any printing apparatus may be used without limitation to the above printer.

(D) Post-treatment

The printed fabrics were subjected to a steaming treatment at 100° C. for 8 minutes for the reactive dye inks, at 100° C. for 30 minutes for the acid dye inks, and at 180° C. for 10 minutes for the disperse dye inks. The thus-treated cloths were washed and then dried.

(E) Evaluation of prints

The thus-obtained print samples and the fabrics used were evaluated in the following manner. The results are shown in Table 1.

(1) Bleeding:

The linearity of fine-line portions in each print sample was visually observed to rank resistance to bleeding in accordance with the following standard:

A: Good;

B: Somewhat poor;

C: Poor.

(2) Color depth (K/S) of print:

A minimum spectral reflectance of a 20×20 mm square printed portion in each print sample was measured by a Minolta Spectrocolorimeter CM-2022 (trade name). A K/S value was found from this reflectance. The color depth of each print sample was ranked in terms of this K/S value in accordance with the following standard:

A: Greater than 13;

B: 10 to 13;

C: Smaller than 10.

(3) Drying property:

Printing was conducted by the BJC-820J printer, and the printed area was rubbed with a cloth upon elapsed time of 30 seconds after the printing. The drying property was evaluated by whether ink smearing occurred or not and ranked in accordance with the following standard:

A: No ink smearing occurred;

C: Ink smearing occurred.

(4) Water repellency:

Each fabric sample was sprayed with 250 ml of water by a Spray Tester (trade name, manufactured by Daiei Kagaku Seiki Seisakusho) in accordance with the water repellency test (spray method) described in JIS L 1092. The water repellency was ranked in terms of 0 to 100 points according to the wet state of the sample after the test.

Comparative Examples 1 to 11

Ink-jet printing and evaluation were conducted in the same manner as in Examples 1 to 12 except that the cloths and the textile printing inks were changed to those shown in Table 2. The results are shown in Table 2.

TABLE 1

| | Cloth | Pretreatment Agent [conc. in aq. solution (%)] | Ink | Water repellency | Resistance to bleeding | Color depth | Drying property |
|---|---|---|---|---|---|---|---|
| Ex. 1 | Cotton | Water repellent 1 [3], Surfactant 1 [1], $Na_2CO_3$ [2] | Reactive | 0 | A | A | A |
| Ex. 2 | Cotton | Water repellent 2 [1], Surfactant 2 [1], $Na_2CO_3$ [2] | Reactive | 0 | A | A | A |
| Ex. 3 | Cotton | Water repellent 1 [3], Surfactant 1 [1], $Na_2SO_4$ [4], $Na_2CO_3$ [2] | Reactive | 0 | A | A | A |
| Ex. 4 | Cotton | Water repellent 1 [3], Surfactant 1 [1], urea [4], $Na_2CO_3$ [2] | Reactive | 0 | A | A | A |
| Ex. 5 | Cotton | Water repellent 1 [3], Surfactant 1 [1], | Reactive | 0 | A | A | A |

TABLE 1-continued

| | Cloth | Pretreatment Agent [conc. in aq. solution (%)] | Ink | Water repellency | Resistance to bleeding | Color depth | Drying property |
|---|---|---|---|---|---|---|---|
| | | $Na_2SO_4$ [4], urea [4], $Na_2CO_3$ [2] | | | | | |
| Ex. 6 | Nylon | Water repellent 1 [3], Surfactant 1 [1] | Acid | 0 | A | A | A |
| Ex. 7 | Nylon | Water repellent 2 [3], Surfactant 1 [1] | Acid | 0 | A | A | A |
| Ex. 8 | Nylon | Water repellent 1 [3], Surfactant 1 [1], $Na_2SO_4$ [4] | Acid | 0 | A | A | A |
| Ex. 9 | Nylon | Water repellent 2 [3], Surfactant 1 [1], $Na_2SO_4$ [4] | Acid | 0 | A | A | A |
| Ex. 10 | Polyester | Water repellent 2 [3], Hydrophilic substance 1 [5] | Disperse | 0 | A | A | A |
| Ex. 11 | Polyester | Water repellent 2 [3], Surfactant 1 [1] | Disperse | 0 | A | A | A |
| Ex. 12 | Polyester | Water repellent 2 [3], Surfactant 2 [1] | Disperse | 0 | A | A | A |

Water repellent 1: Paragium SS (trade name, paraffinic softening water repellent, product of Ohara Paragium Chemical Co., Ltd.).
Water repellent 2: Zebran F-1 (trade name, fluorine-containing type water repellent, product of Ipposha Oil Industries Co., Ltd.).
Surfactant 1: Noigen HC (trade name, nonionic surfactant, product of Dai-ichi Kogyo Seiyaku Co., Ltd.).
Surfactant 2: Neocall SW (trade name, anionic surfactant, product of Dai-ichi Kogyo Seiyaku Co., Ltd.).
Hydrophilic substance 1: Triethylene glycol butyl ether.

TABLE 2

| | Cloth | Pretreatment Agent [conc. in aq. solution (%)] | Ink | Water repellency | Resistance to bleeding | Color depth | Drying property |
|---|---|---|---|---|---|---|---|
| Comp. Ex. 1 | Cotton | $Na_2CO_3$ [2] | Reactive | 0 | C | C | A |
| Comp. Ex. 2 | Cotton | Water repellent 1 [1], $Na_2CO_3$ [2] | Reactive | 70 | A | C | C |
| Comp. Ex. 3 | Cotton | Water repellent 2 [1], $Na_2CO_3$ [2] | Reactive | 90 | A | C | C |
| Comp. Ex. 4 | Cotton | Hydrophilic substance 1 [5], $Na_2CO_3$ [2] | Reactive | 0 | C | B | A |
| Comp. Ex. 5 | Cotton | Surfactant 1 [1], $Na_2CO_3$ [2] | Reactive | 0 | C | C | A |
| Comp. Ex. 6 | Cotton | Surfactant 2 [1], $Na_2CO_3$ [2] | Reactive | 0 | C | C | A |
| Comp. Ex. 7 | Nylon | Surfactant 1 [1] | Acid | 0 | C | C | A |
| Comp. Ex. 8 | Nylon | Hydrophilic substance 1 [5] | Acid | 0 | C | C | A |
| Comp. Ex. 9 | Nylon | Water repellent 1 [1] | Acid | 50 | A | C | C |
| Comp. Ex. 10 | Polyester | Surfactant 1 [1] | Disperse | 0 | C | C | A |
| Comp. Ex. 11 | Polyester | Hydrophilic substance 1 [5] | Disperse | 0 | C | B | A |

Water repellent 1: Paragium SS (trade name, paraffinic softening water repellent, product of Ohara Paragium Chemical Co., Ltd.).
Water repellent 2: Zebran F-1 (trade name, fluorine-containing type water repellent, product of Ipposha Oil Industries Co., Ltd.).
Surfactant 1: Noigen HC (trade name, nonionic surfactant, product of Dai-ichi Kogyo Seiyaku Co., Ltd.).
Surfactant 2: Neocall SW (trade name, anionic surfactant, product of Dai-ichi Kogyo Seiyaku Co., Ltd.).
Hydrophilic substance 1: Triethylene glycol butyl ether.

As apparent from Tables 1 and 2, all the prints according to Examples 1 to 12 were free of bleeding, high in color depth and also excellent in drying property. In particular, the cloth with urea and inorganic salts added thereto described in Example 5 was excellent in resistance to bleeding and coloring ability, whereas the cloths according to Comparative Examples 1 to 11 gave unfavorable results such as low color depth, poor drying property and/or the like.

Examples 13 to 27 and Comparative Examples 12 to 19

Prints were produced in the same manner as in Examples 1 to 12 except that the following fabrics were used as ink-jet printing cloths.

Using a 100% cotton broadcloth (mercerized product), a 100% nylon taffeta fabric and a 100% polyester crepe de Chine, pretreatments 1 using their corresponding agents shown in Tables 3 and 4 were conducted by the padding process. The thus-pretreated fabrics were then squeezed to a pickup of 70% by a mangle and dried at a drying temperature of 120° C. for 2 minutes. The thus-treated fabrics were further subjected to pretreatments 2 using their corresponding agents shown in Tables 3 and 4 were conducted similarly by the padding process. The thus-pretreated fabrics were then squeezed to a pickup of 70% by a mangle and dried at a drying temperature of 120° C. for 2 minutes. Besides the formulations according to the examples as the pretreatment formulations, treatment formulations according to the comparative examples, which are outside the scope of the present invention, are shown in Table 5.

Evaluation of prints:

The thus-obtained print samples and the fabrics used were evaluated in the following manner. The results are shown in Tables 3 to 5.

(1) Bleeding

The linearity of fine-line portions in each print sample was visually observed to rank resistance to bleeding in accordance with the following standard:

A: Good;

B: Somewhat poor;

C: Poor.

(2) Optical density (OD)

The optical density of a solid printed area was measured by a Macbeth densitometer RD918, thereby ranking it in accordance with the following standard:

A: OD value not lower then 1.3;

B: OD value ranging from 0.8 to 1.2;

C: OD value lower than 0.8.

(3) Tendency to strike-through

The optical densities of the front and back surfaces of a solid printed area were measured by a Macbeth densitometer RD918. The tendency to strike-through was ranked in terms of a ratio (OD of the back surface to OD of the front surface) between the OD values in accordance with the following standard:

(Cotton)

A: Not lower than 0.7;

B: 0.60 to 0.69;

C: Lower than 0.60.

(Nylon and polyester)

A: Not lower than 0.9;

B: 0.80 to 0.89;

C: Lower than 0.80.

(4) Drying property

An ink in an amount of 0.03 g was dropped on a cloth to be tested to rank the drying property in terms of time required to absorb the ink in accordance with the following standard:

A: Not longer than 10 seconds;

B: 11 to 30 seconds;

C: Longer than 30 seconds.

(5) Permeability or wetting property (contact angle)

An ink in an amount of 0.03 g was dropped on a cloth to be tested to measure its contact angle with the cloth (the cloth is easier to wet as the contact angle is narrower, i.e., the wetting property is greater).

(Contact angle)

S: Narrower than 90° (unmeasurable due to strike-through);

I: 90 to 110°;

G: Wider then 110°.

(6) Dye distribution

An ink-jet print to be tested was cut so as to permit the observation of its fiber section. The section was observed through a microscope to determine a difference in the concentration of a fixed dye between the peripheral surface and the interior of the fiber. The print was ranked as A where the color was deep in a wide range of the peripheral surface of the fiber because its OD value was also high.

A: The color was deep in a wide range of the peripheral surface of the fiber, but the color was thin in the interior of the fiber;

B: The color was deep only in a part of the peripheral surface of the fiber;

C: The color was even and thin as a whole in both peripheral surface and interior of the fiber.

TABLE 3

| | | Pretreatment 1 | | Pretreatment 2 | | | | | | | | |
|---|---|---|---|---|---|---|---|---|---|---|---|---|
| | Cloth | Agent/conc. in aq. soln. (%) | Cont. angle | Agent/conc. in aq. soln. (%) | Cont. Angle | Ink | Bleeding | OD | Strike-through | Drying prop. | Dye Distr. | Water repell. |
| Ex. 13 | Cotton | Water repell. 1/1, $Na_2CO_3$/2 | G | Surfactant 1/1, $Na_2CO_3$/2 | S | Reactive | A | A | A | A | A | 0 |
| Ex. 14 | Cotton | Water repell. 2/1, $Na_2CO_3$/2 | G | Surfactant 2/1, $Na_2CO_3$/2 | S | Reactive | A | A | A | A | A | 0 |
| Ex. 15 | Cotton | Water repell. 3/1, $Na_2CO_3$/2 | G | Surfactant 3/1, $Na_2CO_3$/2 | S | Reactive | A | A | A | A | A | 0 |
| Ex. 16 | Cotton | Water repell. 2/1, $Na_2CO_3$/2 | G | Surfactant 1/1, $Na_2CO_3$/2 | S | Reactive | A | A | A | A | A | 0 |
| Ex. 17 | Cotton | Water-soluble polymer 1/3, $Na_2CO_3$/2 | G | Surfactant 1/1, $Na_2CO_3$/2 | S | Acid | A | A | A | A | A | 0 |
| Ex. 18 | Nylon | Water repell. 1/1 | G | Surfactant 1/1 | S | Acid | A | A | A | A | A | 0 |
| Ex. 19 | Nylon | Water repell. 2/1 | G | Surfactant 2/1 | S | Acid | A | A | A | A | A | 0 |
| Ex. 20 | Nylon | Water repell. 3/1 | G | Surfactant 3/1 | S | Acid | A | A | A | A | A | 0 |

TABLE 4

| | | Pretreatment 1 | | Pretreatment 2 | | | | | | | | |
|---|---|---|---|---|---|---|---|---|---|---|---|---|
| | Cloth | Agent/conc. in aq. soln. (%) | Cont. angle | Agent/conc. in aq. soln. (%) | Cont. Angle | Ink | Bleeding | OD | Strike-through | Drying prop. | Dye Distr. | Water repell. |
| Ex. 21 | Nylon | Water repell. 2/1 | G | Surfactant 1/1 | S | Acid | A | A | A | A | A | 0 |
| Ex. 22 | Nylon | Water-soluble polymer 1/3 | G | Surfactant 1/1 | S | Acid | A | A | A | A | A | 0 |
| Ex. 23 | Polyester | Cationic substance 1/1 | G | Surfactant 1/1 | S | Disperse | A | A | A | A | A | 0 |
| Ex. 24 | Polyester | Water repell. 1/1 | G | Surfactant 2/1 | S | Disperse | A | A | A | A | A | 0 |
| Ex. 25 | Polyester | Water repell. 2/1 | G | Surfactant 3/1 | S | Disperse | A | A | A | A | A | 0 |

TABLE 4-continued

| | Cloth | Pretreatment 1 Agent/conc. in aq. soln. (%) | Cont. angle | Pretreatment 2 Agent/conc. in aq. soln. (%) | Cont. Angle | Ink | Bleeding | OD | Strike-through | Drying prop. | Dye Distr. | Water repell. |
|---|---|---|---|---|---|---|---|---|---|---|---|---|
| Ex. 26 | Polyester | Water repell. 3/1 | G | Surfactant 1/1 | S | Disperse | A | A | A | A | A | 0 |
| Ex. 27 | Polyester | Water-soluble polymer 1/3 | G | Surfactant 1/1 | S | Disperse | A | A | A | A | A | 0 |

TABLE 5

| | Cloth | Pretreatment 1 Agent/conc. in aq. soln. (%) | Cont. angle | Pretreatment 2 Agent/conc. in aq. soln. (%) | Cont. Angle | Ink | Bleeding | OD | Strike-through | Drying prop. | Dye Distr. | Water repell. |
|---|---|---|---|---|---|---|---|---|---|---|---|---|
| Comp. Ex. 12 | Cotton | $Na_2CO_3$/2 | S | Not conducted | — | Reactive | C | C | B | A | C | 0 |
| Comp. Ex. 13 | Cotton | Water repell. 1/1, $Na_2CO_3$/2 | G | Not conducted | — | Reactive | A | B | C | C | B | 70 |
| Comp. Ex. 14 | Cotton | Water repell. 1/1 $Na_2CO_3$/2 | G | Water repell. 1/1, $Na_2CO_3$/2 | G | Reactive | A | B | C | C | B | 70 |
| Comp. Ex. 15 | Cotton | Surfactant 1/1, $Na_2CO_3$/2 | S | Not conducted | — | Reactive | C | C | B | A | C | 70 |
| Comp. Ex. 16 | Nylon | Water repell. 1/1 | G | Not conducted | — | Acid | A | B | C | C | B | 80 |
| Comp. Ex. 17 | Nylon | Surfactant 1/1 | S | Not conducted | — | Acid | C | C | B | A | C | 0 |
| Comp. Ex. 18 | Polyester | Water repell. 1/1 | G | Not conducted | — | Disperse | A | B | C | C | B | 80 |
| Comp. Ex. 19 | Polyester | Surfactant 1/1 | S | Not conducted | — | Disperse | C | C | B | A | C | 0 |

(Note)

Water repellent 1: Sumifluoil EM51 (trade name, fluorine-containing type water repellent, product of Sumitomo Chemical Co., Ltd.).

Water repellent 2: TSW831/CW80 (trade name, silicone type water repellent, product of Toshiba Silicone Co., Ltd.).

Water repellent 3: Paraguard 519Z (trade name, reactive fluororesin type water repellent, product of Ohara Paragium Chemical Co., Ltd.).

Surfactant 1: Noigen HC (trade name, nonionic surfactant, product of Dai-ichi Kogyo Seiyaku Co., Ltd.).

Surfactant 2: Neocall SW (trade name, anionic surfactant, product of Dai-ichi Kogyo Seiyaku Co., Ltd.).

Surfactant 3: Migregirl GWL (trade name, nonionic surfactant, product of Senka K.K.).

Water-soluble polymer 1: Carboxymethylcellulose.

Cationic substance 1: Sanfix PRO (trade name, polyamine type, product of Sanyo Chemical Industries, Ltd.).

As apparent from Tables 3 to 5, all the prints according to Examples 13 to 27 were free of bleeding, high in color depth on the front surfaces and excellent in tendency to strike-through and drying property, whereas the cloths according to Comparative Examples 12 to 19 could not satisfy all the performance properties at the same time.

In the prior art, it has been said that coloring ability and resistance to bleeding, and tendency to strike-through are contradictory properties, and hence difficult to satisfy at the same time. However, according to the present invention, it has been possible to satisfy all properties of coloring ability, resistance to bleeding, tendency to strike-through and ink-drying property at the same time by causing the permeability or wetting property to inks of the fiber structure to differ between the interior and peripheral surface thereof as described above. In the present invention, the terms "permeability" and "wetting property" are used as substantial synonyms. However, they are sometimes used each in its proper way for ease of understanding. The term "peripheral surface" means fiber surface, i.e., an outer periphery in section of a fiber. For example, if a fiber structure is made resistant to wetting (difficult to be permeated) by an ink on the interior side thereof and, easy to be wetted (easy to be permeated) by the ink on the periphery side thereof like the present invention, the ink impacted on the cloth by ink-jet printing can easily spread in the peripheral direction of the fiber, but is not easily absorbed in the interior (thickness) direction. In such a case, the ink diffuses into the peripheral surface of the fiber and is almost not present in the interior thereof. Such a state is equal, as to the prevention of the diffusion into the interior, to the method in the prior art technique that "the penetration of inks into the interior of fiber is prevented to prevent the diffusion of dyes". However, they differ as to whether the dye diffuses into the peripheral surface of the fiber or not. In the prior art technique, it is difficult for the cloth to be permeated or wetted in both the interior and the peripheral sides of the fiber. Therefore, the inks do not also spread in the peripheral direction of the fiber. Due to this difference in "the spreading in the peripheral direction of the fiber", the prior art technique has provided a cloth failing to satisfy the coloring ability and having poor tendency to strike-through. To the contrary, when the present invention is applied, the area factor becomes great, the coloring ability is enhanced, and the tendency to strike-through is improved because the ink goes along the peripheral surface of the fiber to the back surface.

On the other hand, when compared with the method of the prior art technique that "a surfactant is contained in fiber to absorb inks in the interior of the fiber by diffusion", this prior art technique can improve the tendency to strike-through, but does not achieve effective absorption of light by dyes because the dyes penetrate into the interior of the fiber, and hence can provide only a cloth poor in coloring ability. To the contrary, according to the present invention, no ink is absorbed in the interior of the fiber, and so coloring ability is improved.

As described above, the ink-jet printing cloths and printing processes according to the present invention permit the provision of bright prints excellent in drying property, free of bleeding and high in color depth and image quality.

Besides, the cloths obtained by containing the water repellent and the hydrophilic agent by at least two cloth-treating steps can provide bright prints free of bleeding, high in color depth, good in tendency to strike-through and high in image quality and grade, and are excellent in ink-drying property upon printing, and hence permit textile printing free from ink smearing.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet printing cloth on which textile printing is conducted using an ink-jet system, wherein the cloth contains a water repellent and a hydrophilic agent so as to have a predetermined water repellency.

2. The ink-jet printing cloth according to claim 1, wherein the water repellency is less than 50 marks in terms of the water repellency prescribed by the water repellency test with a spray method described in JIS L 1092.

3. The ink-jet printing cloth according to claim 1, wherein the water repellent is any of paraffinic and fluorine-containing type water repellents.

4. The ink-jet printing cloth according to claim 1, wherein the water repellent is applied in an amount of 0.05 to 40% by weight based on the cloth.

5. The ink-jet printing cloth according to claim 1, wherein the hydrophilic agent is applied in an amount of 0.01 to 50% by weight based on the cloth.

6. The ink-jet printing cloth according to claim 1, further comprising at least one of a water-soluble inorganic salt and urea.

7. The ink-jet printing cloth according to claim 1, wherein the wetting property to inks of the peripheral surface of fiber constituting the cloth is higher than that of the interior of the fiber.

8. A process for producing an ink-jet printing cloth on which textile printing is conducted using an ink-jet system, which comprises the steps of:

applying a water repellent to a cloth;

drying the cloth; and further applying a hydrophilic agent to the dry cloth.

9. The production process according to claim 8, wherein a predetermined water repellency is given to the cloth through the steps according to claim 8.

10. The production process according to claim 9, wherein the water repellency is less than 50 marks in terms of the water repellency prescribed by the water repellency test with a spray method described in JIS L 1092.

11. The production process according to claim 8, wherein the water repellent is any of paraffinic and fluorine-containing type water repellents.

12. The production process according to claim 8, wherein the water repellent is applied in an amount of 0.05 to 40% by weight based on the cloth.

13. The production process according to claim 8, wherein the hydrophilic agent is applied in an amount of 0.01 to 50% by weight based on the cloth.

14. The production process according to claim 8, wherein at least one of a water-soluble inorganic salt and urea is applied to the cloth.

15. The production process according to claim 8, wherein the wetting property to inks of the peripheral surface of fiber constituting the cloth is made higher than that of the interior of the fiber through the steps according to claim 8.

16. An ink-jet printing process comprising the steps of:

preparing a cloth containing a water repellent and a hydrophilic agent and having a predetermined water repellency;

applying an ink containing a dye by an ink-jet system to said cloth;

fixing the dye in said ink to the cloth; and washing the cloth.

17. The ink-jet printing process according to claim 16, wherein a cloth having a water repellency less than 50 marks in terms of the water repellency prescribed by the water repellency test with a spray method described in JIS L 1092 is used.

18. The ink-jet printing process according to claim 16, wherein the water repellent is any of paraffinic and fluorine-containing type water repellents.

19. The ink-jet printing process according to claim 16, wherein the water repellent is applied in an amount of 0.05 to 40% by weight based on the cloth.

20. The ink-jet printing process according to claim 16, wherein the hydrophilic agent is applied in an amount of 0.01 to 50% by weight based on the cloth.

21. The ink-jet printing process according to claim 16, wherein the cloth contains at least one of a water-soluble inorganic salt and urea.

22. The ink-jet printing process according to claim 16, wherein an electrothermal converter which generates thermal energy causing film boiling of ink is used as an energy-generating means for ejecting the ink.

23. The ink-jet printing process according to claim 16, wherein the wetting property to inks of the peripheral surface of fiber constituting the cloth is higher than that of the interior of the fiber.

24. A process for producing a print by applying inks to a cloth using an ink-jet system to print the cloth, which comprises the steps of:

applying inks to a cloth containing a water repellent and a hydrophilic agent and having a predetermined water repellency;

fixing dyes in the inks to the cloth; and washing the thus-treated cloth.

25. The process for producing a print according to claim 24, wherein a concentration of a fixed dye at the peripheral surface of fiber constituting the print is higher than that at the interior of the fiber through the steps according to claim 24.

26. The process according to claim 24, wherein a cloth having a water repellency less than 50 marks in terms of the water repellency prescribed by the water repellency test with a spray method described in JIS L 1092 is used.

27. The process according to claim 24, wherein the water repellent is any of paraffinic and fluorine-containing type water repellents.

28. The process according to claim 24, wherein the water repellent is applied in an amount of 0.05 to 40% by weight based on the cloth.

29. The process according to claim 24, wherein the hydrophilic agent is applied in an amount of 0.01 to 50% by weight based on the cloth.

30. The process according to claim 24, wherein the cloth contains at least one of a water-soluble inorganic salt and urea.

31. The ink-jet printing cloth according to claim 2, wherein the water repellent is any of paraffinic and fluorine-containing type water repellents.

32. An ink-jet printing cloth on which printing is conducted using an ink-jet system, wherein the cloth contains a water repellent and a hydrophilic agent which tends to make an ink spread laterally on the cloth and the cloth has a predetermined water repellency.

* * * * *

UNITED STATES PATENT AND TRADEMARK OFFICE

CERTIFICATE OF CORRECTION

PATENT NO. : 5,867,197

DATED : February 2, 1999

INVENTOR(S) : MAKOTO AOKI

It is certified that error appears in the above-identified patent and that said Letters Patent is hereby corrected as shown below:

ON THE COVER PAGE:

Item [56] FOREIGN PATENT DOCUMENTS

"0459282" should read --4-59282--.

COLUMN 2:

Line 42, "in" should be deleted.

COLUMN 9:

Line 48, "not illustrated." should read --(not illustrated).--.

COLUMN 10:

Line 16, "the" (first occurrence) should read -- the construction--.

UNITED STATES PATENT AND TRADEMARK OFFICE

CERTIFICATE OF CORRECTION

PATENT NO. : 5,867,197

DATED : February 2, 1999

INVENTOR(S) : MAKOTO AOKI

It is certified that error appears in the above-identified patent and that said Letters Patent is hereby corrected as shown below:

COLUMN 11:

Line 31, "inks" should read --inks:--.

Signed and Sealed this

Twenty-first Day of September, 1999

*Attest:*

Q. TODD DICKINSON

*Attesting Officer*

*Acting Commissioner of Patents and Trademarks*